United States Patent [19]

Treiber et al.

[11] 4,450,701

[45] May 29, 1984

[54] METHOD OF FORMING SLATS FOR VENETIAN BLINDS

[75] Inventors: Josef Treiber, Graz; Walter Reichmann, Stainz, both of Austria

[73] Assignee: Metallbau Treiber KG, Graz, Austria

[21] Appl. No.: 352,888

[22] Filed: Mar. 1, 1982

[30] Foreign Application Priority Data

Oct. 20, 1981 [AT] Austria ..... 4474/81

[51] Int. Cl.[3] ..... B21D 5/08

[52] U.S. Cl. ..... 72/181; 72/234; 29/24.5

[58] Field of Search ..... 72/181, 176, 178–180, 72/203, 234; 29/24.5

[56] References Cited

U.S. PATENT DOCUMENTS

| | | | |
|---|---|---|---|
| 1,377,252 | 5/1921 | Hunker | 72/181 |
| 1,951,800 | 3/1934 | Lyon | 72/181 |
| 2,262,550 | 11/1941 | Hunter | 72/179 |
| 2,294,324 | 8/1942 | Wilkens et al. | 72/181 |
| 3,344,641 | 10/1967 | Pomory | 72/179 |
| 4,145,905 | 3/1979 | Mattie | 72/181 |
| 4,267,954 | 5/1981 | Smith | 72/181 |

FOREIGN PATENT DOCUMENTS

| | | | |
|---|---|---|---|
| 295068 | 11/1916 | Fed. Rep. of Germany | 72/178 |

*Primary Examiner*—Daniel C. Crane
*Attorney, Agent, or Firm*—Salter & Michaelson

[57] ABSTRACT

A method of forming slats for venetian blinds and the like is disclosed. An elongated baked enameled metallic strip is subjected to a plurality of gradual bending increments through the use of sequential pairs of forming rollers that form a central longitudinal body section of upwardly arched configuration, longitudinal ribs which extend downwardly and outwardly from the body section and longitudinal edge sections which extend outwardly from the ribs but are curled inwardly to provide marginal edges on the strip. By bending the strip in gradual increments in a preferred sequence with a plurality of pairs of sequential rollers, slats can be formed in a continuous operation wherein bending stresses on the strip are minimized to avoid stress cracks in both the baked enamel and in the metal.

14 Claims, 12 Drawing Figures

METHOD OF FORMING SLATS FOR VENETIAN BLINDS

BACKGROUND OF THE INVENTION

The instant invention relates to a method of forming slats for venetian blinds and the like and more particularly to a method of forming slats for venetian blinds from baked enameled metallic strips.

Venetian blinds having metallic slats of various configurations are currently in use in a variety of interior and exterior applications. In this connection, a particular type of slat having a longitudinal central body section of slightly upwardly arched configuration, longitudinal ribs which extend downwardly and outwardly from opposite sides of the body section and longitudinal edge sections having downwardly and inwardly bent longitudinal marginal edges, has proven particularly effective for external applications. Slats of this configuration are comparatively rigid and they can therefore be formed in extended lengths without sagging. Further, they inherently are disposed in registry when overlaid on one another so that they are particularly adapted for arrangement in compact stacks of reduced height which makes them ideal for use in venetian blinds.

Slats of the type hereinabove described are preferably made of lightweight sheet metal of reduced copper content such as aluminum sheet. For exterior applications, however, it has proven necessary to provide protective coatings on the slats to prevent oxidation of the metal. This is particularly important when the slats are formed of aluminum sheet due to the tendency of aluminum to rapidly oxidize when exposed to the elements which causes the slat surfaces to rapidly become rough, pitted and unattractive. Baked enamel coatings have been found to be effective for protecting the surfaces of metallic slats while simultaneously providing attractive coloration therefor. Thus, baked enamel coatings provide permanent and effective protection against severe environmental conditions and preserve the attractive appearance of the slats indefinitely.

While the use of baked enamel coatings has normally proven to be an effective means of protecting metal sheet in exterior applications, the effectiveness thereof is substantially reduced when the sheet is bent, formed or crimped after the enamel coating has been applied thereto. In particular the bending, forming or crimping of enameled slats by conventional methods has frequently resulted in the formation of minute cracks in both the metal and in the enamel at the areas of bending stresses. While such cracks frequently are initially unnoticeable, they form sites for corrosive attack and therefore substantially reduce the long term effectiveness of the coatings and the durability of the slats. While obviously cracks in the enamel can be avoided by enameling the slats subsequent to, rather than before the forming and bending thereof, such a method is not commercially practical since it is not suited for continuous operations.

SUMMARY OF THE INVENTION

The instant invention overcomes the above stated and other drawbacks encountered with the heretofore known methods by providing a method of continuously forming high-quality baked enameled slats of the above mentioned type without causing cracks in the enamel or in the metal at the areas of bending stress. The instant invention achieves this purpose by providing a method wherein the slats are gradually formed in a continuous multistage bending operation, and wherein particular attention is given to the bending stresses applied to the strip during each phase of the bending operation. A flat baked enameled metallic tape or strip is continuously drawn from a magazine roll and continuously fed through successive pairs of forming rollers to gradually form the desired configuration of the slats in a plurality of gradual bending increments in longitudinal progression. In the initial bending increments, longitudinal ribs are gradually formed on the continuous strip wherein the ribs extend downwardly and outwardly from a central body section to outwardly extending longitudinal edge sections of the strip. After the ribs have been formed, the intersections between the ribs and the body section and the ribs and the edge sections are formed into a rounded configuration. After the longitudinal ribs have been fully formed, the edge sections are gradually bent downwardly and inwardly in bending increments so that the radii of curvature of the inward bends are gradually reduced until the edge sections are shaped in substantially U-shaped configuration. During the final increments of the edge section forming step, the longitudinal body section is formed in a slightly upwardly arched configuration to add longitudinal strength to the strip. In the preferred form of the method, the continuous strip is then fed through a final series of straightening rollers to longitudinally straighten the profiled strip to eliminate any longitudinal warping or deformation caused during the multistage bending operation. Thereafter the strip is cut into individual slats of desired lengths.

The above described method has proven to be effective for forming high-quality baked enameled slats in continuous operations. In particular, stress cracks in the enamel on the slats are substantially avoided by forming the slats in a multistage bending operation wherein the slats are bent in gradual increments to the desired configuration. Further by forming longitudinal ribs in the slats during the initial stages of the method and thereafter forming the downwardly and inwardly bent edge sections, the simultaneous bending of adjacent portions of the strips in different directions is avoided. This also reduces the bending stresses on both the metal and the enamel to further avoid the formation of stress cracks. By forming the strips in longitudinal progression and in a plurality of bending increments, it is possible to form high-quality slats in a continuous process which is efficient and commercially practical.

Both the particular characteristics of the steps and the sequence in which they are performed also have significance in the method of the instant invention. In this connection benefits have been realized in the method of forming the edge sections into a downwardly and outwardly curved configuration during the first increments of the edge forming step. This also reduces the tendency to form stress cracks in the metal sheet and in the enamel layer during the bending of the longitudinal edge sections. It has also proven desirable to complete the formation of the longitudinal edge sections by gradually bending them downwardly and inwardly about symmetrical bending lines until the lines are gradually tilted to a disposition which is substantially horizontal or transverse to the strip. This also tends to reduce the stresses on the bending areas of the strip to avoid the formation of cracks in both the metal itself and in the enamel coating thereon. Further, it has proven effective to form the upwardly arched configuration of the central longitudinal body section during the last portion of the multistaged bending operation. In particular it has proven desirable to form the body section in this manner during the last or the last several increments of the edge section bending step. This has resulted in substantial reduction in the bending stresses on the strip during the bending operation and has reduced the tendency to develop undesired warp or deformation in the strip.

In contrast, the previously known methods for manufacturing slats of similar type have comprised at most two-step methods wherein precut strips are individually formed at work stations. These methods have been impractical because they have required individual handling of slats at the work stations and they have been ineffective for producing high-quality baked enamel slats for the reasons hereinabove mentioned.

For all of the above reasons, it is the primary object of the instant invention to provide a method of forming high-quality baked enameled slats for venetian blinds and the like in a continuous operation.

Another object of the instant invention is to provide a continuous process for forming slats for venetian blinds from a continuous baked enameled strip wherein substantial stress cracks in the metal and the enamel are avoided.

Another object of the instant invention is to provide a commercially practical method of forming slats for venetian blinds that are used in exterior locations.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
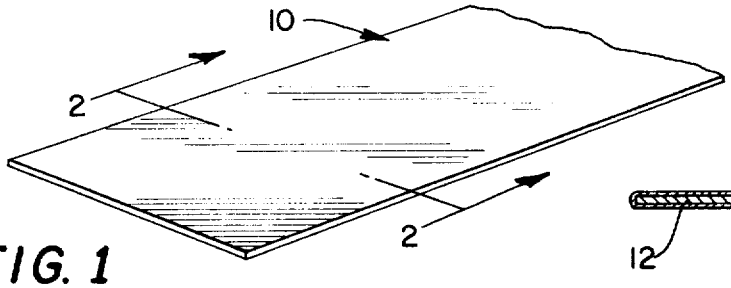
FIG. 1 is a perspective view of an enameled strip prior to the forming of a venetian blind slat therefrom in accordance with the method embodied in the subject invention.
Figure 2:
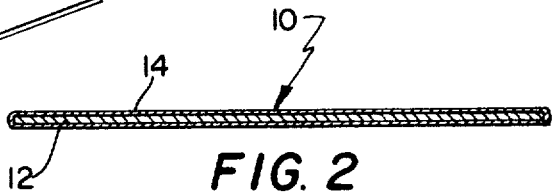
FIG. 2 is a sectional view taken along line 2—2 in FIG. 1.
Figure 3:
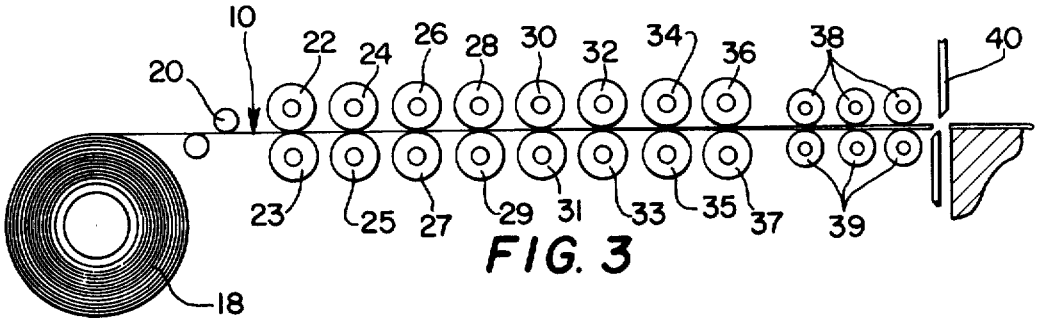
FIG. 3 is a schematic side elevational view of the apparatus used for forming slats in accordance with the instant invention.

Referring now to the drawings, and particularly to FIGS. 1 through 3, a continuous metal strip is generally indicated at 10 and as will be described, the strip 10 is formed in slats for venetian blinds and the like in accordance with the instant invention.

The strip 10 comprises a metallic tape 12 which is preferably made of aluminum or some other relatively formable lightweight metal and has a baked enamel coating 14 thereon. In accordance with the method of the invention, the strip 10 is continuously fed from a feed roll 18 through guide rolls 20 and then through sequential pairs of forming rollers indicated at 22 and 23, 24 and 25, 26 and 27, 28 and 29, 30 and 31, 32 and 33, 34 and 35, and 36 and 37 to effect the bending or formation thereof in longitudinally progressive increments. After the strip 10 passes through the final forming rollers 36 and 37, it is directed through a series of pairs of straightening rollers 38 and 39 to eliminate deformation or warp therein caused during the bending operation. Thereafter, the strip 10 is cut into slats of desired lengths by cutters 40.

Figure 4:
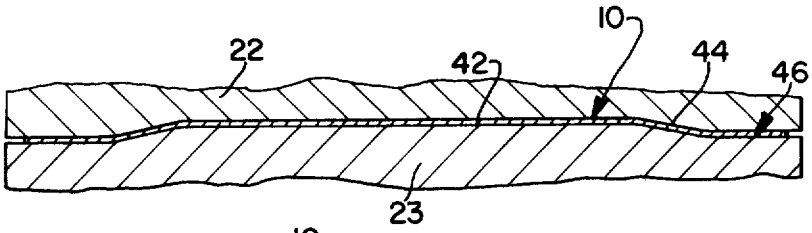
FIGS. 4 through 11 illustrate the sequential forming of the slat in gradual increments in accordance with the instant invention.
Figure 5:
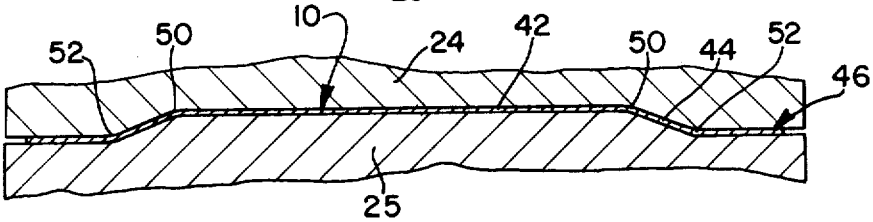

The first step of the method of the instant invention is more clearly illustrated in FIGS. 4 and 5 where it is seen that the strip 10 is initially deformed to define a central longitudinal body section 42, longitudinal ribs 44 which extend downwardly and outwardly from the body section 42 and edge sections generally indicated at 46 which extend outwardly from the ribs 44. As is seen in FIGS. 4 and 5, the ribs 44 are partially formed by the rollers 22 and 23 and thereafter more fully formed by the rollers 24 and 25.

Figure 6:
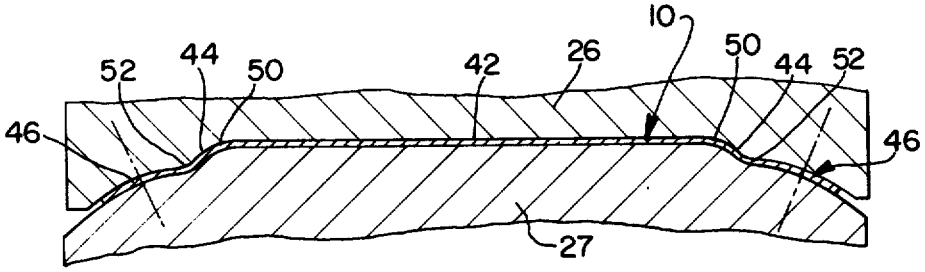
Figure 7:
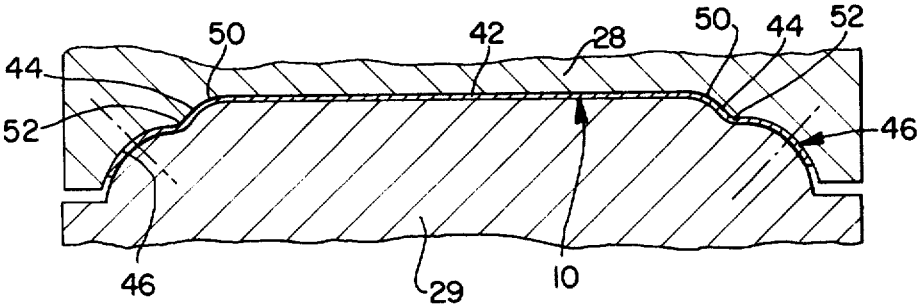
Figure 8:
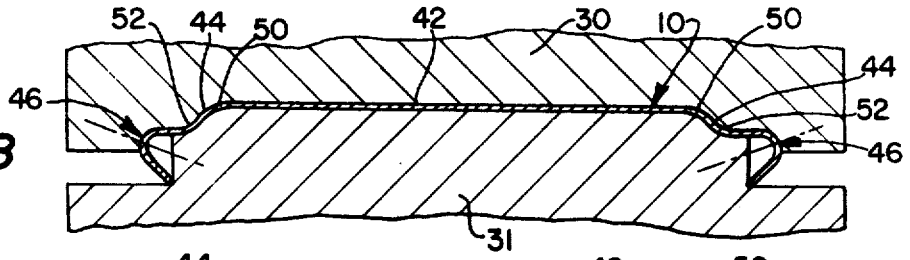
Figure 9:
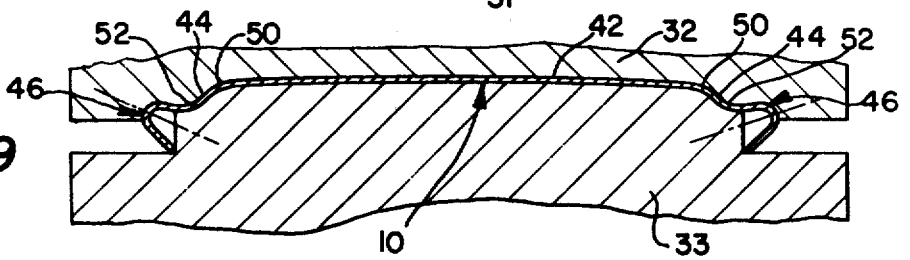
Figure 10:
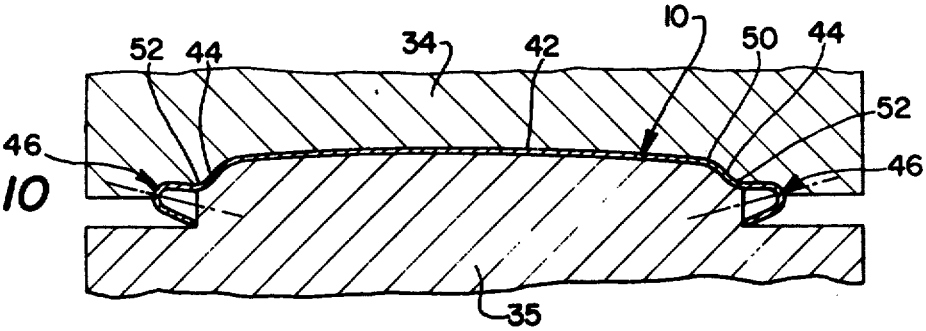
Figure 11:
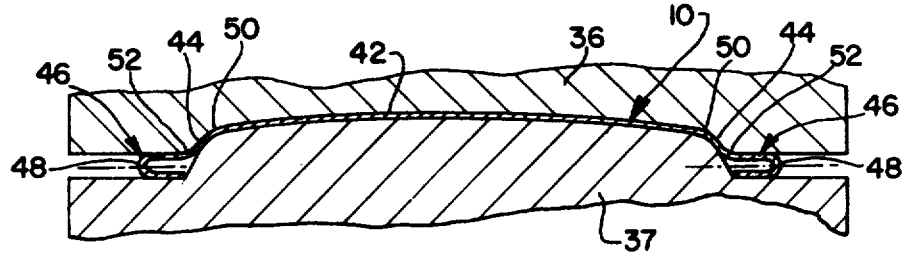
Figure 12:
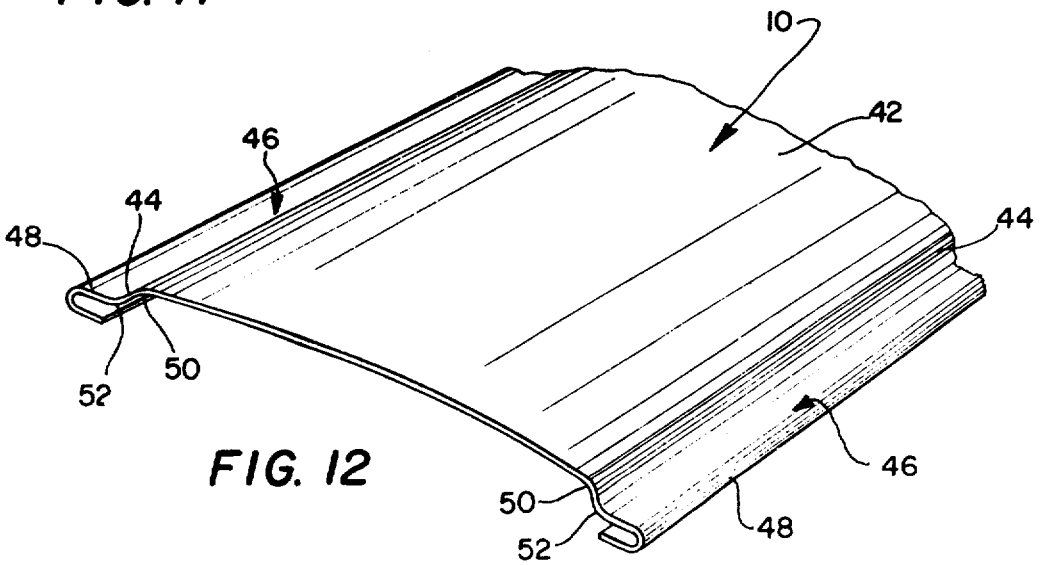
FIG. 12 is a perspective view of a fully formed slat.

The second step of the method of the instant invention is illustrated in FIGS. 6 through 11 wherein it is seen that the edge sections 46 are formed in several increments by cooperating rollers 26 and 27, 28 and 29, 30 and 31, 32 and 33, 34 and 35, and 36 and 37 to define longitudinal marginal edges 48, which are more clearly illustrated in FIGS. 10 and 11. Referring again to FIG. 6, it is seen that during the first bending increment of the edge bending step, the edge sections 46 are bent in slightly downwardly and outwardly curved configuration as the strip 10 is passed through the rollers 26 and 27. Thereafter, as is seen in FIG. 7, the strip 10 is passed through the rollers 28 and 29 where the edge sections 46 are further curved downwardly. In the next increment of the edge bending step illustrated in FIG. 8, the strip 10 is passed through the rollers 30 and 31 and the edge sections 46 are bent further downwardly and inwardly. The strip is then passed through the rollers 32 and 33 as illustrated in FIG. 9, and the edge sections 46 are further bent inwardly producing gradual reductions in the radii of curvature of the inward bends thereof. Thereafter, as illustrated in FIG. 10, in the next increment of the edge section bending step, the radii of curvature of the edge sections 46 are further reduced with the rollers 34 and 35. In the final increment of the step, the rollers 36 and 37 cooperate to further reduce the radius of curvature of each of the edge sections 46 to provide the desired U-shaped marginal edges 48 as illustrated in FIGS. 10 and 11. In the preferred method, the edge sections 46 are gradually formed in several increments as shown with the radii of curvature thereof being gradually reduced about symmetric bending planes as illustrated in FIGS. 6 through 11. This has proven to be the most effective method of bending the edge sections 46 while minimizing the bending stresses on both the tape 12 and the enamel 14 and thereby reducing the chances of developing stress cracks therein. Further, although the edge section bending step as herein illustrated comprises six separate bending increments, it is understood that effectiveness of the method results from the gradual incremental bending of the strip and that therefore variations in the number of bending increments in the edge section bending step are contemplated.

The preferred method of the instant invention also includes a step wherein the intersections between the ribs 44 and the body sections 42 and the intersections between the ribs 44 and the edge sections 46 are formed in a generally arcuate configuration. Although it is understood that these intersections may be arcuate or rounded at various different times during the method, preferably they are formed in the desired arcuate shape during the first increment of the edge section bending step as illustrated in FIG. 6. Accordingly, in the preferred method, the rollers 26 and 27 are adapted to simultaneously effect the initial bending of the edge sections 46 and the rounding of the intersections 50 and 52.

The preferred method of the invention also includes a step wherein the body section 42 is formed into an upwardly arched configuration to add longitudinal strength to the strip 10. In this regard the formation of the upwardly arched configuration in the body section 42 is preferably effected during the final increment or final increments of the edge section bending step. Accordingly, in the preferred method, the rollers 32 and 33, 34 and 35, and 36 and 37 illustrated in FIGS. 9, 10 and 11 are adapted to gradually form the body section 42 into an upwardly arched configuration as the edge sections 46 are gradually formed. By forming the body section 42 in this manner during the final stages of the edge section bending step, undesired warp or distortion in the strip 10 is minimized.

After the strip 10 has been formed in the manner hereinabove described, it has proven desirable to pass the fully formed strip through a series of pairs of straightening rollers whereby undesired warp in the strip 10 is eliminated. In this connection after the strip passes from the rollers 36 and 37, it is directed through a series of pairs of straightening rollers 38 and 39 of substantially the same configuration as the rollers 36 and 37 respectively, whereby undesired warp in the strip 10 is substantially eliminated. After the strip 10 has moved through the rollers 38 and 39, the cutters 40 which are powered by any conventional means cut the strip 10 into slats of desired lengths.

The slats are then provided with holes for the lifting tapes in a usual manner, for example, by punching means (not shown).

It is seen therefore that the method of the instant invention provides an effective means of forming slats for venetian blinds and the like of the type hereinabove described. In particular, it is seen that by forming the slats in gradual increments, severe stresses in the bending areas of the strip are substantially avoided. Further, by first forming the downwardly inclined longitudinal ribs on the strip and thereafter forming the edge sections, the simultaneous bending of adjacent areas of the strip in opposite directions is also avoided to further minimize the bending stresses on the strip. By forming the strips in a continuous process wherein the strip is sequentially fed through pairs of forming rollers, the gradual incremental bending of the strip is effected in a continuous operation making the method particularly adapted for commercial applications. The instant invention therefore provides a commercially practical method of forming high-quality baked enameled slats for venetian blinds and the like which is of substantial commercial significance.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of forming baked enameled sheet metal slats for venetian blinds and the like comprising the steps of first bending an elongated sheet metal strip which has been baked enameled on both sides thereof, to form a longitudinal body section, a pair of substantially symmetrical longitudinal ribs and a pair of substantially symmetrical longitudinal edge sections in said strip, said strip being formed so that when it is in a substantially horizontal disposition said ribs extend outwardly and downwardly from the side edges of said body section and said edge sections extend outwardly from said ribs; and thereafter gradually bending said edge sections in a plurality of gradual bending increments in longitudinal progression so that when said strip is in a substantially horizontal disposition said edge sections are gradually bent downwardly and inwardly upon themselves to form marginal edges of substantially U-shaped cross section, the dispositions of said ribs relative to said body section being maintained substantially unchanged after the initial formation of said ribs, said entire method being carried out without bending an area of said strip first in one direction and thereafter in an opposite direction to avoid the formation of stress cracks in said enamel.

2. In the method of claim 1, said edge section bending step further including:

a. bending said edge sections in longitudinal progression to a slightly downwardly and outwardly curved arcuate configuration; and b. gradually bending said arcuate edge sections downwardly and inwardly in a plurality of increments in longitudinal progression to form longitudinal marginal edges of U-shaped cross section.

3. The method of claim 1, further comprising the steps of bending said strip in longitudinal progression to form arcuate longitudinal intersections between said ribs and said central body section and said ribs and said edge sections and thereafter cutting said strip into slats.

4. In the method of claim 3, said step of bending said strip to form arcuate longitudinal intersections between said ribs and said body section and said ribs and said edge sections being effected immediately after said rib forming step.

5. The method of claim 1, further comprising the steps of bending said body section in longitudinal progression to a slightly upwardly arched configuration and thereafter cutting said strip into slats.

6. In the method of claim 5, said body section bending step being effected during the last portion of said edge section bending step.

7. In the method of claim 5, said body section bending step being effected during the last increment of said edge section bending step.

8. In the method of claim 1, said gradual edge section bending step further characterized as gradually bending said edge sections downwardly and inwardly in a plurality of increments in longitudinal progression about symmetric bending planes until the planes are substantially transverse to said strip.

9. In the method of claim 1, said rib forming step further characterized as forming a pair of longitudinal ribs in at least two bending increments in longitudinal progression.

10. In the method of claim 1, said strip being aluminum.

11. In the method of claim 1, said edge section bending step further characterized as bending said strip by passing it through sequential pairs of profiled forming rollers.

12. In the method of claims 1 or 11, said rib forming step further characterized as forming said strip by passing it through sequential pairs of profiled forming rollers.

13. The method of claim 12, further comprising the steps of feeding said strip through a series of profiled longitudinal straightening rollers to longitudinally straighten said strip and thereafter cutting said strip into slats.

14. The method of claim 11, further comprising the steps of feeding said strip through a series of profiled longitudinal straightening rollers to longitudinally straighten said strip and thereafter cutting said strip into slats.

* * * * *